US006283929B1

(12) United States Patent
Mjehovic

(10) Patent No.: US 6,283,929 B1
(45) Date of Patent: Sep. 4, 2001

(54) APPARATUS FOR MASSAGING A BODY

(76) Inventor: Ante Mjehovic, Josipa Pupacica 6, 20000 Dubrovnik (HR)

( * ) Notice: Subject to any disclaimer, the term of this patent is extended or adjusted under 35 U.S.C. 154(b) by 0 days.

(21) Appl. No.: 09/401,220

(22) Filed: Sep. 22, 1999

(51) Int. Cl.[7] ..... A61H 7/00

(52) U.S. Cl. ..... 601/136; 601/98; 601/101; 601/103

(58) Field of Search ..... 601/97, 98, 100, 601/101, 103, 107, 108, 111, 136, 115

(56) References Cited

U.S. PATENT DOCUMENTS

| | | | | |
|---|---|---|---|---|
| 2,826,181 | * | 6/1958 | Holland | 601/108 |
| 3,078,843 | * | 2/1963 | Brisson | 601/101 |
| 3,898,985 | | 8/1975 | Butcher et al. | 128/63 |
| 4,041,938 | | 8/1977 | Wintoniw | 128/52 |
| 4,071,021 | | 1/1978 | Gallacci | 128/52 |
| 4,686,968 | * | 8/1987 | Scherger | 601/108 |
| 4,721,100 | | 1/1988 | Hengl | 128/57 |
| 4,875,470 | * | 10/1989 | Cotone | 128/57 |
| 4,984,568 | * | 1/1991 | Persaud | 128/51 |
| 5,016,617 | * | 5/1991 | Tarlow et al. | 601/101 |
| 5,078,125 | * | 1/1992 | Schumacher | 601/101 |
| 5,097,823 | * | 3/1992 | Kempler | 601/111 |
| 5,582,582 | | 12/1996 | Chapman | 601/112 |
| 5,916,182 | * | 6/1999 | Fengler | 601/111 |

* cited by examiner

*Primary Examiner*—Michael A. Brown
*Assistant Examiner*—Benjamin K. Koo
(74) *Attorney, Agent, or Firm*—Richard L. Miller

(57) ABSTRACT

An apparatus for massaging a body lying in a prone position that includes a frame and a massaging assembly. The frame includes a base, a post, a transverse member, a track, and end caps. The massaging assembly includes a housing, a motor with a drive shaft, a battery, a drive pulley, a driven assembly, an axle, a pair of wheels, a driven pulley, and a belt. When the motor is energized by the battery, the drive shaft rotates, which rotates the drive pulley, which rotates the belt, which rotates the driven pulley, which rotates the axle, which rotates the pair of wheels, which causes the pair of wheels to rotate on the track bar and cause the massage assembly to traverse longitudinally relative to the track bar. The massage assembly further includes a limit switch. When the massaging assembly traverses the track bar in one direction, the limit switch is activated by engagement with one end cap of the track bar, and when activated, reverses polarity of the motor causing the motor to rotate in reverse causing the massage assembly to traverse in an opposite direction until the limit switch is activated by engagement with the other end cap of the track bar, and when activated, reverses polarity of the motor causing the motor to rotate in reverse causing the massage assembly to traverse in the one direction, and back and forth.

19 Claims, 2 Drawing Sheets

APPARATUS FOR MASSAGING A BODY

BACKGROUND OF THE INVENTION

1. Field of the Invention

The present invention relates to an apparatus for massaging. More particularly, the present invention relates to an apparatus for massaging a body.

2. Description of the Prior Art

Numerous innovations for massaging devices have been provided in the prior art that will be described. Even though these innovations may be suitable for the specific individual purposes to which they address, however, they differ from the present invention.

A first example, U.S. Pat. No. 3,898,985 to Butcher et al. teaches a body motion system that can be attached or can be made integral with a bed or similar structure. A horizontal support has a central portion which can subside upon receiving a subject and can move a subject's body in several directions. The ends of the support are coupled to receive a motive force, as from a reciprocally-movable piston for moving the support in a lateral direction to exercise the subject. Alternate motions imparted to the support cause both ends of the support to move in: the same lateral direction, opposite lateral directions, or in a transverse plane wherein both ends of the support move in parallel planes perpendicular to the axis of the support. The modes of operation can rock the subject either gently or forcefully. Simultaneous modes of operation are also possible. In an alternate arrangement, the entire body is placed on the support and the ends of the support are twisted in opposite directions causing a rolling motion to be transmitted to the support.

A second example, U.S. Pat. No. 4,041,938 to Wintoniw teaches massage apparatus for stimulating a hand massage by a masseuse including a bracket having a plurality of flexible massage fingers for contact with the torso. The bracket is simultaneously reciprocal in a horizontal and vertical direction and can oscillate as the fingers massage the torso.

A third example, U.S. Pat. No. 4,071,021 to Gallacci teaches two vertically elongated shafts that are mounted parallel to a wall, and are driven by a motor-powered mechanism that moves the shafts up and down in simple harmonic motion. Any one of a plurality of scratching attachments can be detachably secured between the ends of the shafts.

A fourth example, U.S. Pat. No. 4,721,100 to Hengl teaches a massaging machine that comprises a roller brush having a plurality of radially extending flexible fingers thereon, the brush rotating about a horizontal axis so that the fingers massage a person lying below the brush. The brush is slidable horizontally on a cantilevered frame which is swingable about a horizontal axis and is counterweighted, the position of the counterweight being adjustable so as to adjust the pressure with which the fingers of the roller brush contact the user. The brush is bodily slidable along the horizontal frame, and a counterweight is automatically slidable in the opposite direction as the brush, to maintain constant the pressure of the brush on the user. The fingers of the brush are releasably retained by a horizontal member, immediately before they contact the user, so that the fingers are bent back and then snap against the user.

A fifth example, U.S. Pat. No. 5,582,582 to Chapman teaches a back massaging mechanism for massaging a user's back including a first pair of spaced parallel bars; a pair of downwardly extending telescopic legs coupled to each bar and positionable upon a recipient surface to thereby create a space for accommodating a user lying in a generally horizontal position with his back facing upwards; an elongated cross rail extended between the bars; a guiding mechanism for guiding movement of the cross rail along the bars; a massaging mechanism including a housing coupled to the cross rail for longitudinal slidable moveable therealong, a plurality of rotatable heads with extending fingers coupled to and projected downwards from the housing and with the fingers of the heads positionable upon the user's back, and a first drive mechanism for moving the housing along the cross rail and for simultaneously rotating the heads; and a second drive mechanism for moving the cross rail along the bars and with the fingers of the heads thus longitudinally and transversely moveable for massaging an extent of the user's back.

It is apparent that numerous innovations for massaging devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide an apparatus for massaging a body that avoids the disadvantages of the prior art.

Another object of the present invention is to provide an apparatus for massaging a body that is simple and inexpensive to manufacture.

Still another object of the present invention is to provide an apparatus for massaging a body that is simple to use.

Briefly stated, yet another object of the present invention is to provide an apparatus for massaging a body lying in a prone position that includes a frame and a massaging assembly. The frame includes a base, a post, a transverse member, a track, and end caps. The massaging assembly includes a housing, a motor with a drive shaft, a battery, a drive pulley, a driven assembly, an axle, a pair of wheels, a driven pulley, and a belt. When the motor is energized by the battery, the drive shaft rotates, which rotates the drive pulley, which rotates the belt, which rotates the driven pulley, which rotates the axle, which rotates the pair of wheels, which causes the pair of wheels to rotate on the track bar and cause the massage assembly to traverse longitudinally relative to the track bar. The massage assembly further includes a limit switch. When the massaging assembly traverses the track bar in one direction, the limit switch is activated by engagement with one end cap of the track bar, and when activated, reverses polarity of the motor causing the motor to rotate in reverse causing the massage assembly to traverse in an opposite direction until the limit switch is activated by engagement with the other end cap of the track bar, and when activated, reverses polarity of the motor causing the motor to rotate in reverse causing the massage assembly to traverse in the one direction, and back and forth.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

First Embodiment

Figure 1:
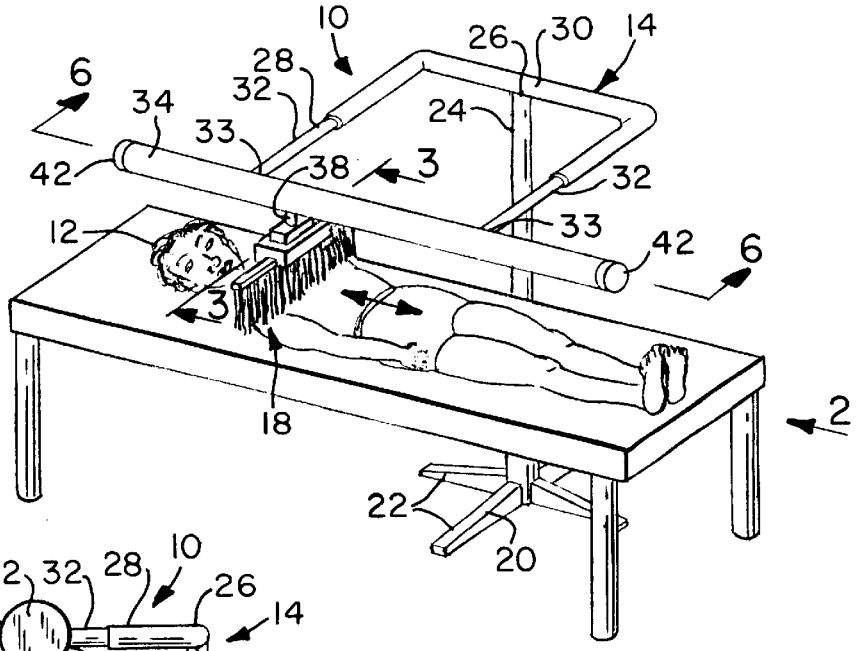
FIG. 1 is a diagrammatic perspective view of a first embodiment of the present invention in use.

10 apparatus of the present invention for massaging body 12 lying in prone position
12 body
14 frame for resting on floor 16
16 floor
18 massaging assembly for massaging body 12
20 base of frame 14 for resting on floor 16
22 foldable legs of base 20 of frame 14 for easy storage and transport
24 post of frame 14
26 upper terminal end of post 24 of frame 14
28 transverse member of frame 14
30 center of transverse member 28 of frame 14
32 pair of legs of transverse member 28 of frame 14
33 terminal ends of pair of legs 32 of transverse member 28 of frame 14
34 track bar of frame 14
36 open ends of track bar 34 of frame 14
38 lowermost surface of track bar 34 of frame 14
40 throughslot in lowermost surface 38 of track bar 34 of frame 14
42 end caps of track bar 34 of frame 14
44 housing of massaging assembly 18
46 first portion of housing 44 of massaging assembly 18
48 second portion of housing 44 of massaging assembly 18
50 open top of second portion 48 of housing 44 of massaging assembly 18
52 closed bottom of second portion 48 of housing 44 of massaging assembly 18
54 throughslot in closed bottom 52 of second portion 48 of housing 44 of massaging assembly 18
56 subfloor contained in second portion 48 of housing 44 of massaging assembly 18
58 motor of massaging assembly 18
60 drive shaft of motor 58 of massaging assembly 18
62 battery of massaging assembly 18
64 drive pulley of massaging assembly 18
66 driven assembly of massaging assembly 18
68 axle of driven assembly 66 of massaging assembly 18
70 pair of ends of axle 68 of driven assembly 66 of massaging assembly 18
72 pair of wheels of driven assembly 66 of massaging assembly 18
74 driven pulley of driven assembly 66 of massaging assembly 18
76 belt of driven assembly 66 of massaging assembly 18
78 massaging brush of massaging assembly 18
80 spine of massaging brush 78 of massaging assembly 18
82 bristles of massaging brush 78 of massaging assembly 18 for engagement with body 12 as massage assembly 18 traverses along track bar 34
84 limit switch of massaging assembly 18
86 on/off switch of massaging assembly 18

Second Embodiment

110 apparatus
114 frame
124 post
128 transverse member

DETAILED DESCRIPTION OF THE PREFERRED EMBODIMENT

Figure 2:
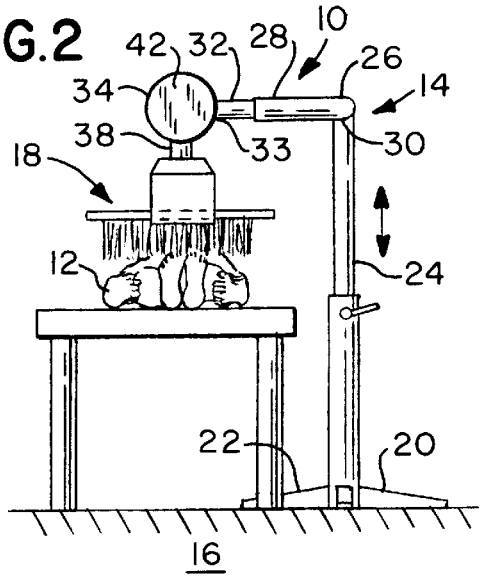
FIG. 2 is a diagrammatic end elevational view taken generally in the direction of arrow 2 in FIG. 1.
Figure 3:
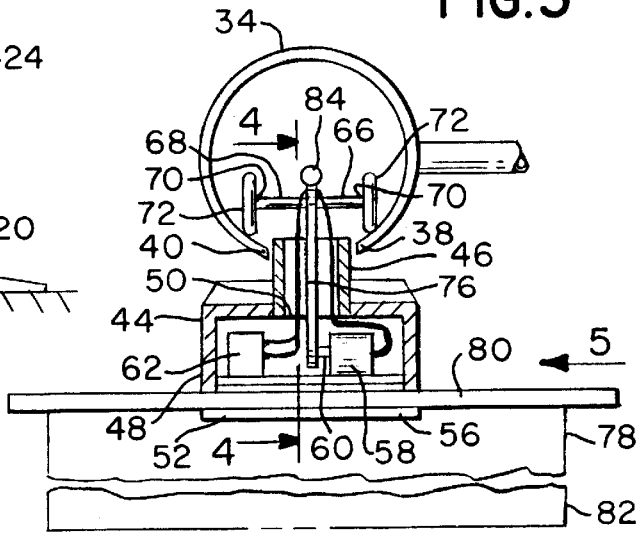
FIG. 3 is an enlarged diagrammatic cross sectional view taken on line 3—3 in FIG. 1.

Referring now to the figures, in which like numerals indicate like parts, and particularly to FIGS. 1 and 2, the apparatus of the present invention is shown generally at 10 for massaging a body 12 lying in a prone position.

The overall configuration of the apparatus 10 can best be seen in FIGS. 1 and 2, and as such, will be discussed with reference thereto.

The apparatus 10 comprises a frame 14 for resting on a floor 16 and a massaging assembly 18 movably mounted to the frame 14 for massaging the body 12.

Figure 6:
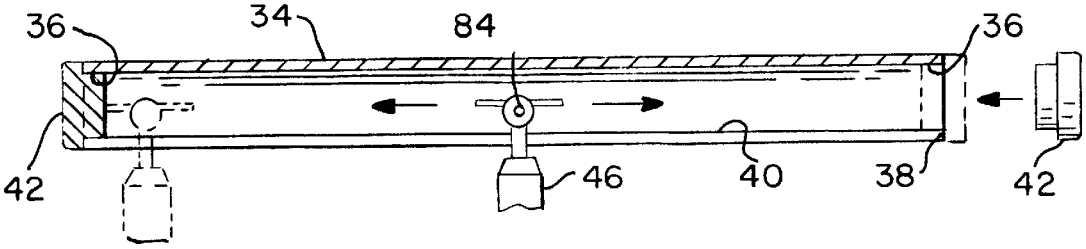
FIG. 6 is an enlarged diagrammatic cross sectional view taken on line 6—6 in FIG. 1.
Figure 4:
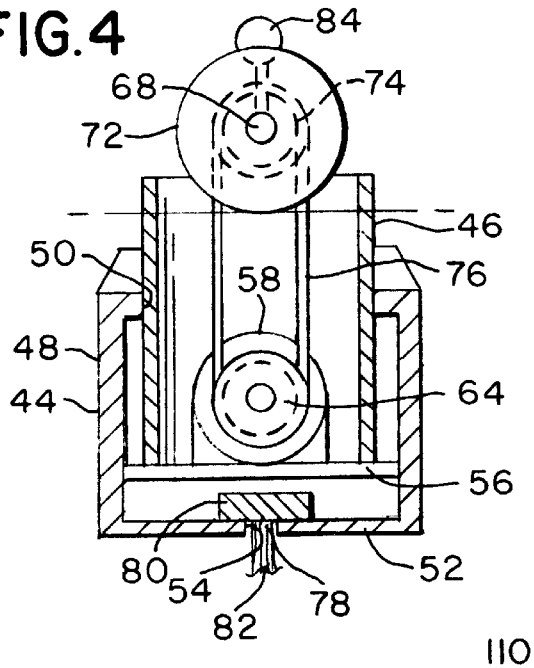
FIG. 4 is an enlarged diagrammatic cross sectional view taken on line 4—4 in FIG. 3.
Figure 5:
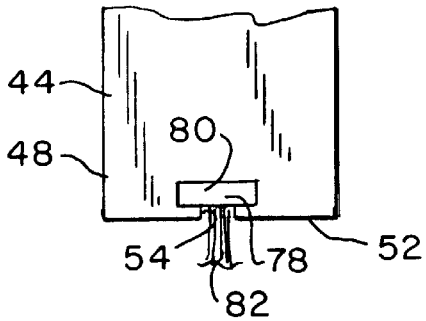
FIG. 5 is an enlarged diagrammatic side elevational view taken generally in the direction of arrow 5 in FIG. 3.

The specific configuration of the frame 14 can best be seen in FIGS. 1, 2, and 6, and as such, will be discussed with reference thereto.

The frame 14 comprises a base 20 that is horizontally-oriented for resting on the floor 16 and comprising foldable legs 22 for easy storage and transport.

The frame 14 further comprises a post 24 that extends vertically upwardly from the base 20 and terminates in an upper terminal end 26.

The post 24 is round in lateral profile and telescopic for height adjustment.

The frame further comprises a transverse member 28 that extends horizontally outwardly from the upper terminal end 26 of the post 24.

The transverse member 28 is U-shaped and has a round lateral profile and a center 30 disposed on the upper terminal end 26 of the post 24 and a pair of legs 32 that are length adjustable for reach from the post 24 and which terminate in terminal ends 33.

The frame 14 further comprises a track bar 34 that is slender, elongated, hollow, horizontally-oriented, has open ends 36 and a lowermost surface 38, and extends equidistantly from the terminal ends 33 of the pair of legs 32, in a same plane as that of the transverse member 28.

The lowermost surface 38 of the track bar 34 has a throughslot 40 that extends longitudinally therealong, from one open end 36 to the other open end 36 of the track bar 34.

The open ends 36 of the track bar 34 are closed by end caps 42.

The specific configuration of the massaging assembly 18 can best be seen in FIGS. 3–7, and as such, will be discussed with reference thereto.

The massaging assembly 18 comprises a housing 44 that depends movably from the track bar 34.

The housing 44 comprises a first portion 46 that fittingly communicates in and depends from the throughslot 40 in the track bar 34. The first portion 46 of the housing 44 is slender, elongated, hollow, and vertically-oriented.

The housing 44 further comprises a second portion 48 that depends from the first portion 46 of the housing 44. The second portion 48 of the housing 44 is rectangular-parallelepiped-shaped, and has an open top 50 that receivingly communicates with the first portion 46 of the housing 44 and a closed bottom 52 that is horizontally-oriented.

The closed bottom 52 of the second portion 48 of the housing 44 has a throughslot 54 that extends therealong.

The second portion 48 of the housing 44 further contains a subfloor 56 that is disposed parallel to and slightly above the closed bottom 52 of the second portion 48 of the housing 44.

The massage assembly 18 further comprises a motor 58 that is disposed on the subfloor 56 in the second portion 48 of the housing 44 and has a drive shaft 60 that extends horizontally therefrom.

The massage assembly 18 further comprises a battery 62 that is disposed on the subfloor 56 in the second portion 48 of the housing 44 and is in electrical communication with and powers the motor 58.

The massage assembly 18 further comprises a drive pulley 64 that is affixed on the drive shaft 60 of the motor 58 for rotation therewith and is vertically-oriented.

The massage assembly 18 further comprises a driven assembly 66 that is movably disposed in the track bar 34 and operatively connected to the drive pulley 64.

The driven assembly 66 comprises an axle 68 that is disposed movably in and extends horizontally and transversely across the track bar 34 and has a pair of ends 70.

The driven assembly 66 further comprises a pair of wheels 72 that are disposed on the pair of ends 50 of the axle 68, respectively, for rotation therewith. The pair of wheels 72 are vertically-oriented and roll longitudinally in the track bar 34, on the lowermost surface 38 of the track bar 34, straddling the throughslot 40 in the track bar 34.

The driven assembly 66 further comprises a driven pulley 74 that is disposed on the axle 68 for rotation therewith, between the pair of wheels 72, is vertically-oriented, and in line with the drive pulley 64.

The driven assembly 66 further comprises a belt 76 that engages the driven pulley 74, passes vertically through the first portion 46 of the housing 44, and engages the drive pulley 64, and when the motor 58 is energized by the battery 48, the drive shaft 60 rotates, which rotates the drive pulley 64, which rotates the belt 76, which rotates the driven pulley 74, which rotates the axle 68, which rotates the pair of wheels 72, which causes the pair of wheels 72 to rotate on the track bar 34 and cause the massage assembly 18 to traverse longitudinally relative to the track bar 34.

The massage assembly 18 further comprises a massaging brush 78 that depends from the second portion 48 of the housing 44. The massaging brush 78 has a spine 80 that rests on the closed bottom 52 of the second portion 48 of the housing 44, below the subfloor 56, and overlays the throughslot 54 in the in the closed bottom 52 of the second portion 48 of the housing 44.

The massaging brush 78 further comprises bristles 82 that depend from the spine 80, through the throughslot 54 in the track bar 34 for engagement with the body 12 as the massage assembly 18 traverses along the track bar 34.

The massaging assembly 18 further comprises a limit switch 84 that extends upwardly in the track bar 34 and is affixed for movement with the massaging assembly 18, and when the massaging assembly 18 traverses the track bar 34 in one direction, the limit switch 84 is activated by engagement with one end cap 42 of the track bar 34, and when activated, reverses polarity of the motor 58 causing the motor 58 to rotate in reverse causing the massage assembly 18 to traverse in an opposite direction until the limit switch 84 is activated by engagement with the other end cap 42 of the track bar 34, and when activated, reverses polarity of the motor 58 causing the motor 58 to rotate in reverse causing the massage assembly 18 to traverse in the one direction, and back and forth.

The massaging assembly 18 further comprises an on/off switch 86 in electrical communication with the motor 58.

Figure 8:
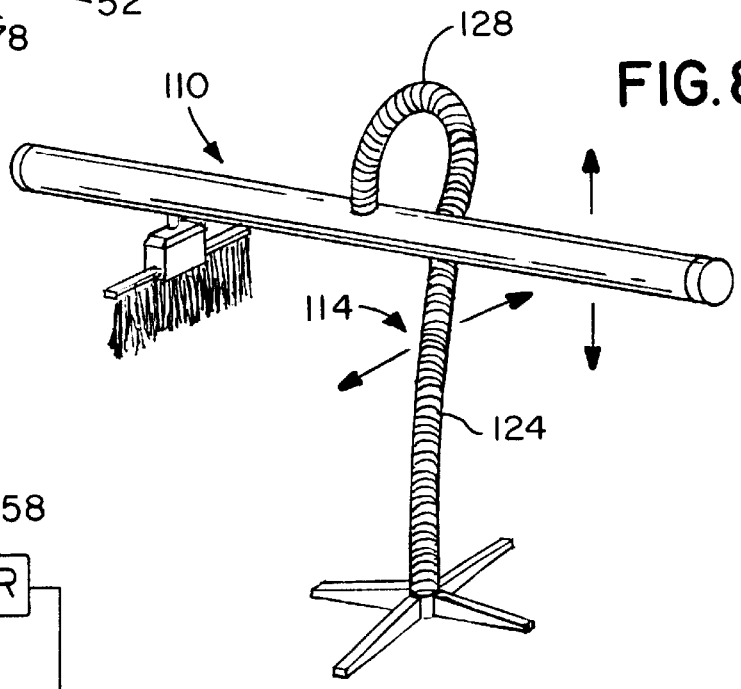
FIG. 8 is a diagrammatic cross sectional view of a second embodiment of the present invention.
Figure 7:
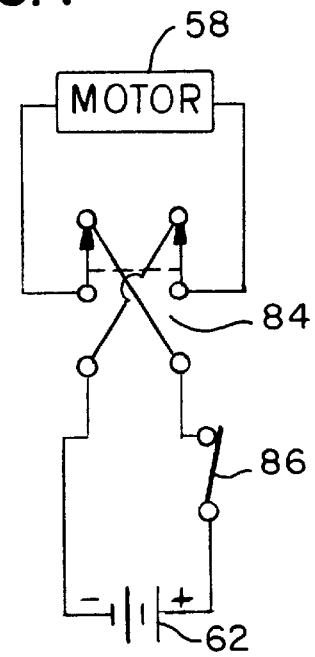
FIG. 7 is a schematic diagram of the circuit of the present invention.

The configuration of a second embodiment of the apparatus 110 can best be seen in FIG. 8, and as such, will be discussed with reference thereto.

The apparatus 110 is similar to the apparatus 10, except both the post 124 and the transverse member 128 of the frame 114 are formed as one piece of flexible tubing allowing for height and reach adjustment.

It will be understood that each of the elements described above, or two or more together, may also find a useful application in other types of constructions differing from the types described above.

While the invention has been illustrated and described as embodied in an apparatus for massaging a body, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An apparatus for massaging a body lying in a prone position, comprising:

a) a frame for resting on a floor; and b) a massaging assembly movably mounted to said frame 14 for massaging the body, wherein said frame comprises a base for resting on the floor and comprises foldable legs for easy storage and transport, wherein said frame further comprises a post that extends from said base and terminates in an upper terminal end, wherein said frame further comprises a transverse member that extends outwardly from said upper terminal end of said post, wherein said transverse member is U-shaped and has:

A) a round lateral profile;

B) a center disposed on said upper terminal end of said post; and

C) a pair of legs that are length adjustable for reach from said post and which terminate in terminal ends, wherein said frame further comprises a track bar that is slender, elongated, hollow, extends equidistantly from said terminal ends of said pair of legs, in a same plane as that of said transverse member, and has:

i) open ends; and ii) a lowermost surface, wherein said lowermost surface of said track bar has a throughslot that extends longitudinally therealong, from one open end to the other open end of said track bar, wherein said open ends of said track bar are closed by end caps, wherein said massaging assembly comprises a housing that depends movably from said track bar, wherein said housing comprises a first portion that fittingly communicates in and depends from said throughslot in said track bar, wherein said housing further comprises a second portion that depends from said first portion of said housing, wherein said second portion of said housing is rectangular-parallelepiped-shaped, parallelepiped-shaped, and has:

I) an open top that receivingly communicates with said first portion of said housing; and II) a closed bottom, wherein said closed bottom of said second portion of said housing has a throughslot that extends therealong, wherein said second portion of said housing further contains a subfloor that is disposed parallel to and slightly above said closed bottom of said second portion of said housing, wherein said massage assembly further comprises a motor that is disposed on said subfloor in said second portion of said housing and has a drive shaft that extends therefrom, wherein said massage assembly further comprises a battery that is disposed on said subfloor in said second portion of said housing and is in electrical communication with and powers said motor, wherein said massage assembly further comprises a drive pulley that is affixed on said drive shaft of said motor for rotation therewith, wherein said massage assembly further comprises a driven assembly that is movably disposed in said track bar and operatively connected to said drive pulley, wherein said driven assembly comprises an axle that is disposed movably in and extends transversely across said track bar and has a pair of ends, wherein said driven assembly comprises a pair of wheels that are disposed on said pair of ends of said axle, respectively, for rotation therewith.

2. The apparatus as defined in claim 1, wherein said post is round in lateral profile and telescopic for height adjustment.

3. The apparatus as defined in claim 1, wherein said first portion of said housing is slender, elongated, and hollow.

4. The apparatus as defined in claim 1, wherein said pair of wheels are vertically-oriented and roll longitudinally in said track bar on said lowermost surface of said track bar and straddle said throughslot in said track bar.

5. The apparatus as defined in claim 1, wherein said driven assembly further comprises a driven pulley that is disposed on said axle for rotation therewith, between said pair of wheels, is vertically-oriented, and in line with said drive pulley.

6. The apparatus as defined in claim 5, wherein said driven assembly further comprises a belt that engages said driven pulley, passes vertically through said first portion of said housing, and engages said drive pulley, and when said motor is energized by said battery, said drive shaft rotates, which rotates said drive pulley, which rotates said belt, which rotates said driven pulley, which rotates said axle, which rotates said pair of wheels, which causes said pair of wheels to rotate on said track bar and cause said massage assembly to traverse longitudinally relative to said track bar.

7. The apparatus as defined in claim 1, wherein said massaging assembly further comprises an on/off switch in electrical communication with said motor.

8. The apparatus as defined in claim 1, wherein both said post and said transverse member of said frame are formed as one piece of flexible tubing allowing for height and reach adjustment.

9. An apparatus for massaging a body lying in a prone position, comprising:

a) a frame for resting on a floor; and b) a massaging assembly movably mounted to said frame 14 for massaging the body, wherein said frame comprises a base for resting on the floor and comprises foldable legs for easy storage and transport, wherein said frame further comprises a post that extends from said base and terminates in an upper terminal end, wherein said frame further comprises a transverse member that extends outwardly from said upper terminal end of said post, wherein said transverse member is U-shaped and has:

A) a round lateral profile;

B) a center disposed on said upper terminal end of said post; and

C) a pair of legs that are length adjustable for reach from said post and which terminate in terminal ends, wherein said frame further comprises a track bar that is slender, elongated, hollow, extends equidistantly from said terminal ends of said pair of legs, in a same plane as that of said transverse member, and has:

i) open ends; and ii) a lowermost surface, wherein said lowermost surface of said track bar has a throughslot that extends longitudinally therealong, from one open end to the other open end of said track bar, wherein said open ends of said track bar are closed by end caps, wherein said massaging assembly comprises a housing that depends movably from said track bar, wherein said housing comprises a first portion that fittingly communicates in and depends from said throughslot in said track bar, wherein said housing further comprises a second portion that depends from said first portion of said housing, wherein said second portion of said housing is rectangular-parallelepiped-shaped, and has:

I) an open top that receivingly communicates with said first portion of said housing; and II) a closed bottom, wherein said closed bottom of said second portion of said housing has a throughslot that extends therealong, wherein said second portion of said housing further contains a subfloor that is disposed parallel to and slightly above said closed bottom of said second portion of said housing, wherein said massage assembly further comprises a massaging brush that depends from said second portion of said housing, wherein said massaging brush has a spine that rests on said closed bottom of said second portion of said housing, below said subfloor, and overlays said throughslot in said closed bottom of said second portion of said housing.

10. The apparatus as defined in claim 9, wherein said massaging brush further has bristles that depend from said spine, through said throughslot in said track bar for engagement with the body as said massage assembly traverses along said track bar.

11. The apparatus as defined in claim 9, wherein said massaging assembly further comprises an on/off switch in electrical communication with said motor.

12. The apparatus as defined in claim 9, wherein both said post and said transverse member of said frame are formed as one piece of flexible tubing allowing for height and reach adjustment.

13. The apparatus as defined in claim 9, wherein said post is round in lateral profile and telescopic for height adjustment.

14. The apparatus as defined in claim 9, wherein said first portion of said housing is slender, elongated, and hollow.

15. An apparatus for massaging a body lying in a prone position, comprising:

a) a frame for resting on a floor; and b) a massaging assembly movably mounted to said frame 14 for massaging the body, wherein said frame comprises a base for resting on the floor and comprises foldable legs for easy storage and transport, wherein said frame further comprises a post that extends from said base and terminates in an upper terminal end, wherein said frame further comprises a transverse member that extends outwardly from said upper terminal end of said post, wherein said transverse member is U-shaped and has:

A) a round lateral profile;

B) a center disposed on said upper terminal end of said post; and

C) a pair of legs that are length adjustable for reach from said post and which terminate in terminal ends, wherein said frame further comprises a track bar that is slender, elongated, hollow, extends equidistantly from said terminal ends of said pair of legs, in a same plane as that of said transverse member, and has:

i) open ends; and ii) a lowermost surface, wherein said lowermost surface of said track bar has a throughslot that extends longitudinally therealong, from one open end to the other open end of said track bar, wherein said open ends of said track bar are closed by end caps, wherein said massaging assembly comprises a housing that depends movably from said track bar, wherein said housing comprises a first portion that fittingly communicates in and depends from said throughslot in said track bar, wherein said housing further comprises a second portion that depends from said first portion of said housing, wherein said second portion of said housing is rectangular-parallelepiped-shaped, and has:

I) an open top that receivingly communicates with said first portion of said housing; and II) a closed bottom, wherein said closed bottom of said second portion of said housing has a throughslot that extends therealong, wherein said second portion of said housing further contains a subfloor that is disposed parallel to and slightly above said closed bottom of said second portion of said housing, wherein said massage assembly further comprises a motor that is disposed on said subfloor in said second portion of said housing and has a drive shaft that extends therefrom, wherein said massaging assembly further comprises a limit switch that extends upwardly in said track bar and is affixed for movement with said massaging assembly, and when said massaging assembly traverses said track bar in one direction, said limit switch is activated by engagement with one end cap of said track bar, and when activated, reverses polarity of said motor causing said motor to rotate in reverse causing said massage assembly to traverse in an opposite direction until said limit switch is activated by engagement with the other end cap of said track bar, and when activated, reverses polarity of said motor causing said motor to rotate in reverse causing said massage assembly to traverse in said one direction, and back and forth.

16. The apparatus as defined in claim 15, wherein said massaging assembly further comprises an on/off switch in electrical communication with said motor.

17. The apparatus as defined in claim 15, wherein both said post and said transverse member of said frame are formed as one piece of flexible tubing allowing for height and reach adjustment.

18. The apparatus as defined in claim 15, wherein said post is round in lateral profile and telescopic for height adjustment.

19. The apparatus as defined in claim 15, wherein said first portion of said housing is slender, elongated, and hollow.

* * * * *